US011814733B2

(12) United States Patent
Pérez Soldevila et al.

(10) Patent No.: US 11,814,733 B2
(45) Date of Patent: Nov. 14, 2023

(54) DEVICE FOR SOLIDIFYING A COATING LAYER HOT-DEPOSITED ON A WIRE, AND CORRESPONDING INSTALLATION AND PROCEDURE

(71) Applicant: DRUIDS PROCESS TECHNOLOGY, S.L., Granollers (ES)

(72) Inventors: Raimon Pérez Soldevila, Granollers (ES); Mario Gregorio Angeloni, Granollers (ES); Albert Puigcorbé Alcalá, Granollers (ES)

(73) Assignee: DRUIDS PROCESS TECHNOLOGY, S.L., Granollers (ES)

( * ) Notice: Subject to any disclaimer, the term of this patent is extended or adjusted under 35 U.S.C. 154(b) by 0 days.

(21) Appl. No.: 17/611,640

(22) PCT Filed: May 16, 2019

(86) PCT No.: PCT/ES2019/070325
§ 371 (c)(1),
(2) Date: Nov. 16, 2021

(87) PCT Pub. No.: WO2020/229710
PCT Pub. Date: Nov. 19, 2020

(65) Prior Publication Data

US 2022/0228249 A1 Jul. 21, 2022

(51) Int. Cl.

| | |
|---|---|
| ***C23C 2/28*** | (2006.01) |
| ***C23C 2/00*** | (2006.01) |
| ***C23C 2/38*** | (2006.01) |

(52) U.S. Cl.
CPC ..... *C23C 2/28* (2013.01); *C23C 2/003* (2013.01); *C23C 2/38* (2013.01)

(58) Field of Classification Search
CPC .. C23C 2/28; C23C 2/003; C23C 2/38; C23C 2/185; C23C 2/20; C23C 2/29; C23C 2/16
See application file for complete search history.

(56) References Cited

U.S. PATENT DOCUMENTS 3,611,986 A 10/1971 Pierson
3,743,535 A * 7/1973 Padjen et al. ..... C23C 2/28 118/69

(Continued)

OTHER PUBLICATIONS

International Search Report from corresponding International Application No. PCT/ES2019/070325 dated Jan. 3, 2020.

(Continued)

*Primary Examiner* — Hai Y Zhang
(74) *Attorney, Agent, or Firm* — Tucker Ellis LLP

(57) ABSTRACT

Device for solidifying a coating layer hot deposited on a wire-, corresponding installation and method. The device comprises a cooling liquid injection chamber with a liquid inlet and a wire inlet, a cooling chamber with a liquid outlet and a wire outlet, and a partition arranged between the injection and cooling chambers, comprising a wire passage. It also has a conduit for separating the wire. The partition comprises channels fluidically connecting the injection chamber with the cooling chamber and leading into the center of the wire passage in an eccentric manner and being inclined forming an angle with respect to a longitudinal direction-. This directs a jet of cooling liquid on the wire in the direction from the injection chamber towards the cooling chamber.

5 Claims, 7 Drawing Sheets

(56) References Cited

U.S. PATENT DOCUMENTS

| | | | |
|---|---|---|---|
| 2005/0103263 | A1 | 5/2005 | Kitsuwa |
| 2014/0239081 | A1 | 8/2014 | Schlecht et al. |

OTHER PUBLICATIONS

International Preliminary Report on Patentability from corresponding International Application No. PCT/ES2019/070325 dated Apr. 20, 2021.

* cited by examiner

DEVICE FOR SOLIDIFYING A COATING LAYER HOT-DEPOSITED ON A WIRE, AND CORRESPONDING INSTALLATION AND PROCEDURE

RELATED APPLICATION DATA

This application is a national phase application of International Application No. PCT/ES2019/070325 filed May 16, 2019. The entirety of the aforementioned application is incorporated herein by reference.

FIELD OF THE INVENTION

The invention relates to a device for solidifying a coating layer hot deposited on a wire, said device extending along a longitudinal direction defining the path of passage of said wire.

Furthermore, the invention also relates to an installation and a method for solidifying a coating layer hot deposited on a wire with a device according to the invention.

STATE OF THE ART

In a continuous wire coating process, this wire is submerged in a bath containing the coating layer in liquid state. An example of this method is the method for galvanizing a wire, in which the wire is driven through a zinc bath.

The wire exits the bath with a liquid coating layer that gradually cools down by radiation and convection into the environment. Due to the extremely slow cooling, the layer is usually cooled to solidification by means of water jets that hit the wire. The water is ejected in a direction perpendicular to the wire path and pours into a draining tray.

This method has several drawbacks. First, the cooling speed is limited by the jet speed, which is low. On the other hand, the system generally experiences water leakages above the molten metal bath, which entails a significant risk for the operator who is controlling the line.

Furthermore, the system requires an adjustment depending on the water feed pressure, such that there is a need to have operators specialized in controlling the coating line.

Finally, another significant drawback is that the known solidification methods require a lot of space to achieve sufficient solidification so that the wire can be handled without any risk of damaging the coating layer.

SUMMARY OF THE INVENTION

The object of the invention is to provide a device for solidifying a coating layer hot deposited on a wire which is more efficient than the known devices and allows reducing the space required for solidification. This purpose is achieved by means of a device for solidifying a coating layer hot deposited on a wire of the type indicated above, characterized in that it comprises a cooling liquid injection chamber with a cooling liquid inlet and a wire inlet, a cooling chamber with a cooling liquid outlet and a wire outlet, a partition arranged between said injection and cooling chambers, comprising a wire passage communicating said injection chamber and said cooling chamber with one another, a conduit for separating said wire, extending between said wire inlet and said wire passage, said partition comprises a plurality of channels fluidically connecting said injection chamber with said cooling chamber, said plurality of channels leading into the center of said wire passage in an eccentric manner and being inclined with respect to said longitudinal direction for aiming a jet of cooling liquid on said wire in the direction from said injection chamber to said cooling chamber.

The wire the coating layer of which is to be solidified is guided along the longitudinal axis, between the inlet, the wire passage conduit, and the outlet. Thanks to the eccentricity of the channels transporting the cooling liquid, there is formed a vortex which reaches the highest speed downstream of the passage formed in the partitioning wall. On the other hand, in terms of the inclination with respect to the longitudinal axis in the forward movement direction, it has been verified during the development of the invention that a perpendicular impact would cause deformation of the layer, whereas an almost parallel impact would not provide sufficient cooling.

The invention is applicable, for example, for cooling a Zn layer arranged on a wire. Nevertheless, many other types of coatings, such as Zn and Al alloys in proportions between 0.5 and 20% of Al, Zn, Al, and Mg alloys, polymers, paints, copper, and other coatings hot deposited on a wire, can be used.

All this leads to the device according to the invention having cooling rates of the order of 8000-12000 $W/m^2K$, about 10-20 times greater than in the case of conventional cooling with an atmospheric jet. Furthermore, the rotating component forming the vortex allows obtaining a more stable flow. This favors the formation of a uniform coating. All this leads to being able to significantly reduce the length of the solidification installation.

In a particularly preferred manner, said liquid is water so that in the event of the accidental shutdowns of the solidification installation in which the cooling circuit stops, only water would pour from the lower part of the installation. In particular, in a particularly preferred manner the cooling liquid is one selected from the group consisting of mains water, demineralized water, a solution of salts and/or polymers in water. Thanks to that, the design of the device is simplified and safety increased. Water is a cooling liquid that is readily available in industries and, furthermore, its handling is not dangerous. On the other hand, this avoids the need to store other specific liquids. Alternatively, glycol or cutting oil, known in the art as cutting fluid, can be used.

In a particularly preferred manner, said longitudinal axis is arranged in the vertical direction to reduce the linear space taken up by the device.

The invention further includes a number of preferred features that are object of the dependent claims and the utility of which will be highlighted hereinafter in the detailed description of an embodiment of the invention.

Preferably, each channel of said plurality of channels seen on a plane perpendicular to said longitudinal direction has a first side wall and a second side wall, said first and second side walls being configured such that at least one of them is eccentric to said longitudinal axis, and the other one is at least radial, the prolongation of said first and second side walls being on one and the same side of said longitudinal axis. Thanks to the first side wall being at least radial, the formation of turbulences is avoided and the vortex effect is maximized.

In a preferred embodiment having the objective of maximizing the cooling of the wire downstream of the wire passage, said injection chamber is cylindrical. Thanks to the cylindrical shape, turbulences in the injection chamber are reduced and higher speed at the outlet of the passage of the wire as well as a more homogenous vortex, maximizing heat exchange with the surface of the wire, are achieved.

One of the problems associated with the cooling of the coating layer consists of an irregular impact of the cooling liquid on the surface of the wire. An irregular impact would cause undesirable deformation or undulation of the coating layer. Therefore, in order to avoid deformations in said layer, in a preferred embodiment each channel of said plurality of channels forms an angle with respect to the longitudinal direction which is comprised between 10 and 40° and preferably between 12 and 30°.

It has been found that the return of the cooling liquid to the area of the wire passage that would provide access to the injection chamber also causes deformations. To avoid this problem, in another embodiment, on the side of said cooling chamber, said partitioning wall forms a projection in said cooling chamber tapering in the direction from said injection chamber towards said cooling chamber and ending in said wire passage conduit. Thanks to the projection, the cooling liquid is separated from the wire passage and possible turbulences in this area are reduced.

In another particularly preferred embodiment, said inlet is eccentric with respect to said longitudinal axis, such that it is at least tangent to the outer diameter of the conduit for separating said wire.

Also in a particularly preferred manner, said inlet is transverse with respect to said longitudinal axis, such that the axis of said inlet forms an angle between 0 and 30° with respect to the plane perpendicular to said longitudinal axis. Turbulences in the area of the partitioning wall, downstream of the wire passage, are again reduced. This avoids irregularities in the coating layer before passing through the wire passage.

Another embodiment has the objective of preventing the cooling liquid from exiting through the wire outlet. To that end, in a particularly preferred manner the walls of said cooling chamber, at the end of said wire outlet, taper between said cooling chamber and said wire outlet in the form of a Coanda surface. The Coanda surface is adapted to the viscosity of said cooling liquid so that the liquid which pours by gravity follows the wall of the cooling chamber.

The invention also relates to an installation for solidifying a coating layer hot deposited on a wire. To achieve optimum cooling, the installation comprises devices according to the invention.

On the other hand, the installation comprises a cooling liquid tank, thrusting means fluidically connecting said tank with said liquid inlet of said device for injecting the cooling liquid into the injection chamber, and suction means fluidically connecting said liquid outlet of said device with said tank for discharging said cooling liquid from said cooling chamber to said tank and forming a cooling circuit.

On the other hand, in order to increase the cooling speed, in a preferred embodiment of the installation, said installation comprises a plurality of devices and the devices of said plurality of devices are connected in series through the corresponding wire inlets and outlets, and in the installation, furthermore, said tank and said suction means are arranged in fluid communication with each of the corresponding liquid inlet conduits of said plurality of devices for injecting the cooling liquid into the corresponding injection chamber and with each of the corresponding liquid outlets of said plurality of devices for discharging said cooling liquid from the corresponding chamber to form said cooling circuit. The larger number of devices allows significantly increasing the wire passage speed.

Also for the purpose of reducing the space taken up by the installation, said at least one device 1 is arranged such that said longitudinal direction is the vertical direction.

Finally, the invention also relates to a method for solidifying a coating layer hot deposited on a wire using a device according to the invention. The method comprises the following steps of: moving said wire forward along a longitudinal direction, and projecting onto said wire a plurality of jets of cooling liquid, eccentric with respect to the center of said wire and transverse to said longitudinal direction in the forward movement direction of said wire.

In a particularly preferred embodiment of the method according to the invention, said method further comprises the step of creating a negative pressure downstream of said step of projecting during the forward movement of said wire.

In another embodiment of the method according to the invention having the objective of achieving a more stable flow, in said step of projecting said liquid is injected with a flow rate between 2 and 25 l/min.

Finally, to avoid deformations in the coating layer, in a particularly preferred embodiment of the method, said plurality of jets of cooling liquid forms an angle with respect to the longitudinal direction which is comprised between 10 and 40° and preferably between 12 and 30°.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
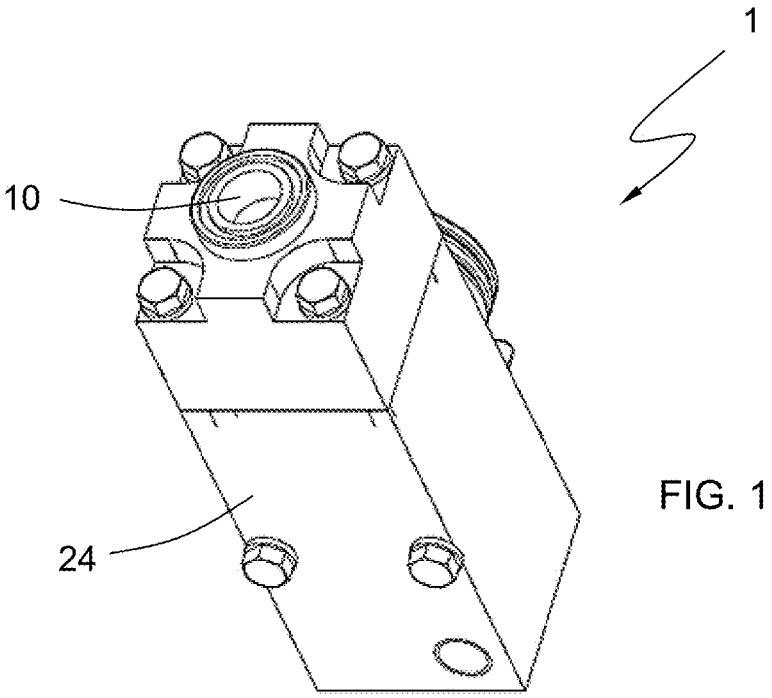
FIG. 1 shows a bottom side perspective view of the device according to the invention.

FIGS. 1 to 4 show a device 1 according to the invention for solidifying a coating layer hot deposited on a wire 108. This coating layer can be, for example but in a non-limiting manner, a zinc layer, a Zn and Al alloy in proportions between 0.5 and 20% of Al, Zn, Al, and Mg alloys, polymers, paints, copper, and other coatings hot deposited on the wire 108.

The device 1 has an elongated outer casing 24 extending along a longitudinal direction L. This longitudinal direction defines the path of passage of the wire 108.

The casing 24 forms therein a cooling liquid injection chamber 2. The injection chamber 2 has a cooling liquid inlet 6 and a wire inlet 4.

Figure 2:
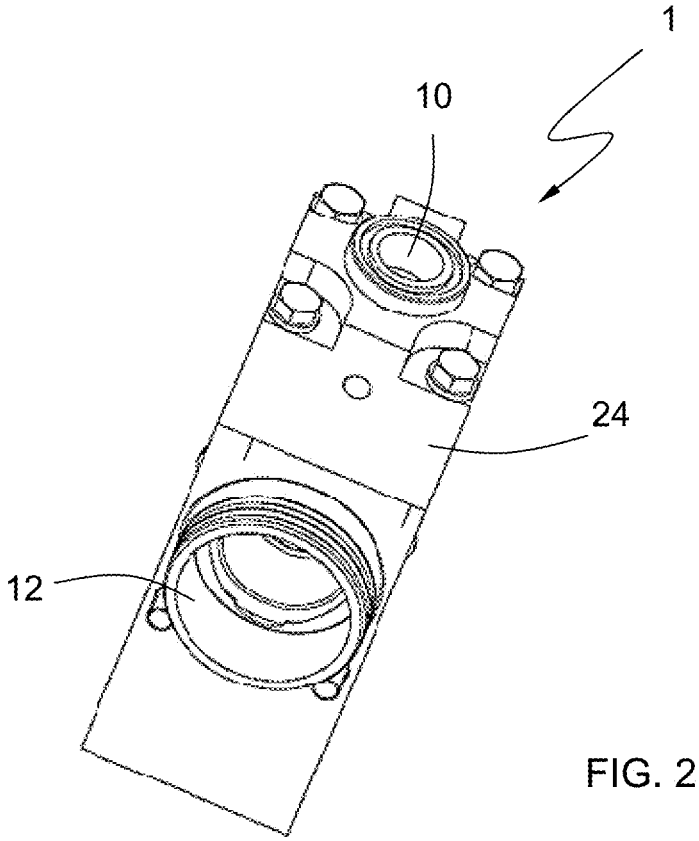
FIG. 2 shows a bottom a side perspective view of the device of FIG. 1.

On the other hand, FIG. 2 also shows how the device 1 has a cooling chamber 8 with a cooling liquid outlet 12 and a wire outlet 10.

A partition 14 is provided between the injection chamber 2 and the cooling chamber 8. This partition has a wire passage 16 communicating the injection chamber 2 and the cooling chamber 8 with one another.

There is also provided in the injection chamber 2 a conduit 22 for separating the wire 108, extending between the wire inlet 4 and the wire passage 16. This conduit 22 prevents the wire 108 from being subjected to the effects of the cooling liquid when it is injected into the injection chamber 2 through the liquid inlet 6. The cooling liquid directly hitting the surface of the wire 108 in a perpendicular direction while the coating is still hot may damage the quality of the coating.

Figure 3:
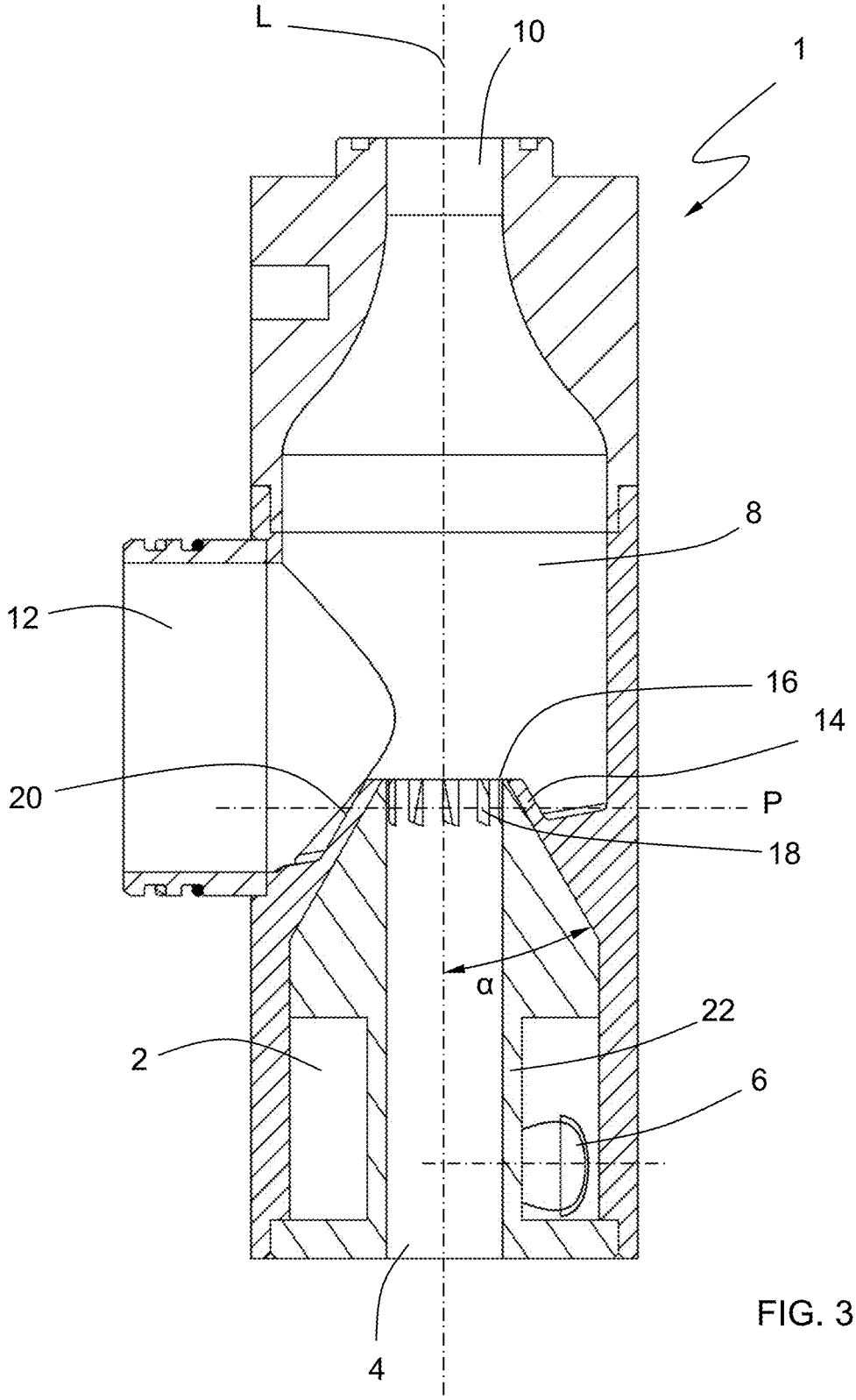
FIG. 3 shows a longitudinally sectioned view of the device of FIG. 1.

FIG. 3 shows that the liquid inlet 6, which in this case is formed by a cylindrical conduit, is eccentric with respect to the longitudinal axis L. Also for avoiding turbulences inside the injection chamber, in a preferred embodiment the inlet is tangent to the outer diameter of the conduit 22 for separating the wire 108. This favours the formation of a vortex inside the injection chamber 2.

Figure 4:
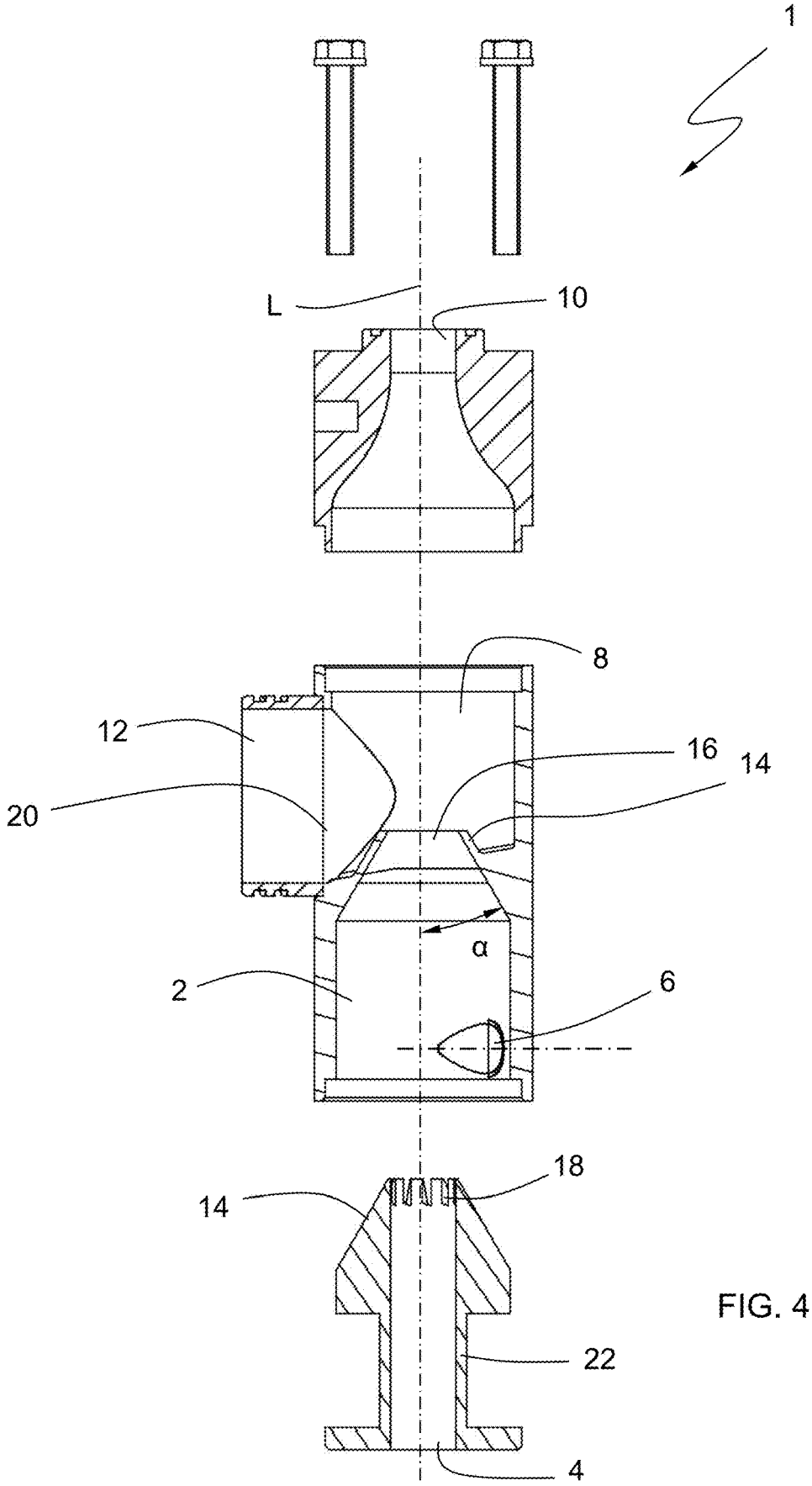
FIG. 4 shows an exploded, longitudinally sectioned view of the device of FIG. 1.

FIG. 4 also shows how the partition 14 has a plurality of channels 18 fluidically connecting the injection chamber 2 with the cooling chamber 8. It can be seen in FIG. 5 how this plurality of channels 18 leads in an eccentric manner relative to the centre of the wire passage 16. On the other hand, these channels 18 are furthermore inclined forming an angle $\alpha$ with respect to the longitudinal direction L for directing a jet of cooling liquid on the wire 108 in the direction from the injection chamber 2 towards the cooling chamber 8.

Figure 10:
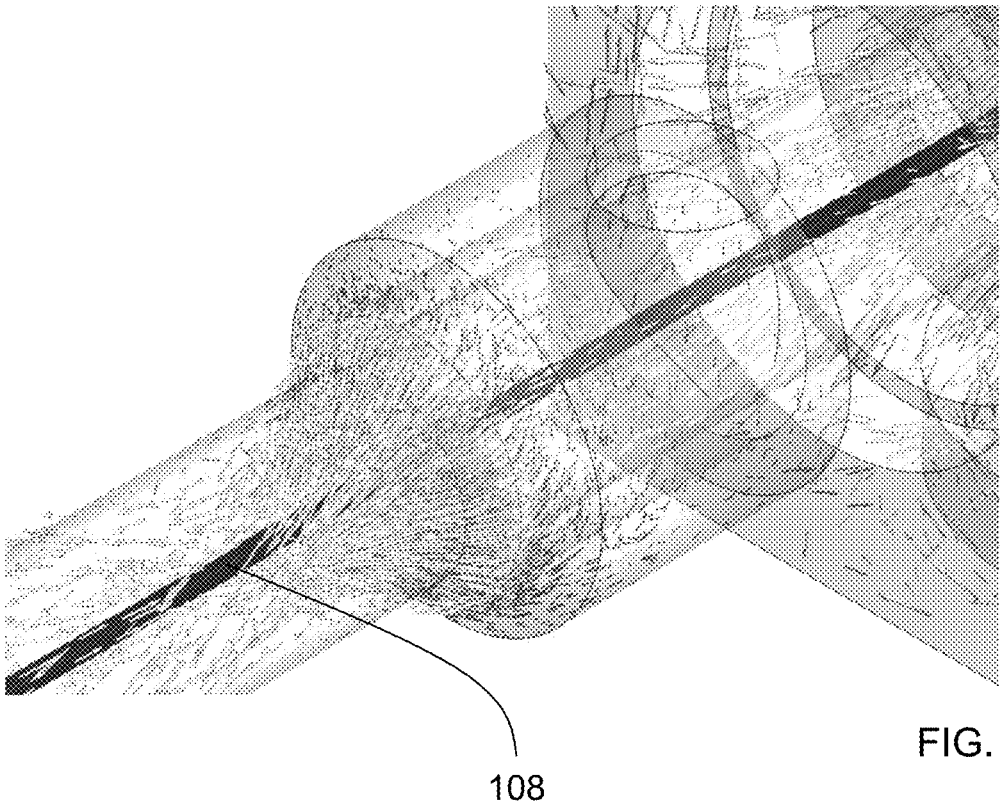
FIG. 10 shows a perspective view of a computer-assisted simulation in which the vortex formed on the wire can be seen.
Figure 11:
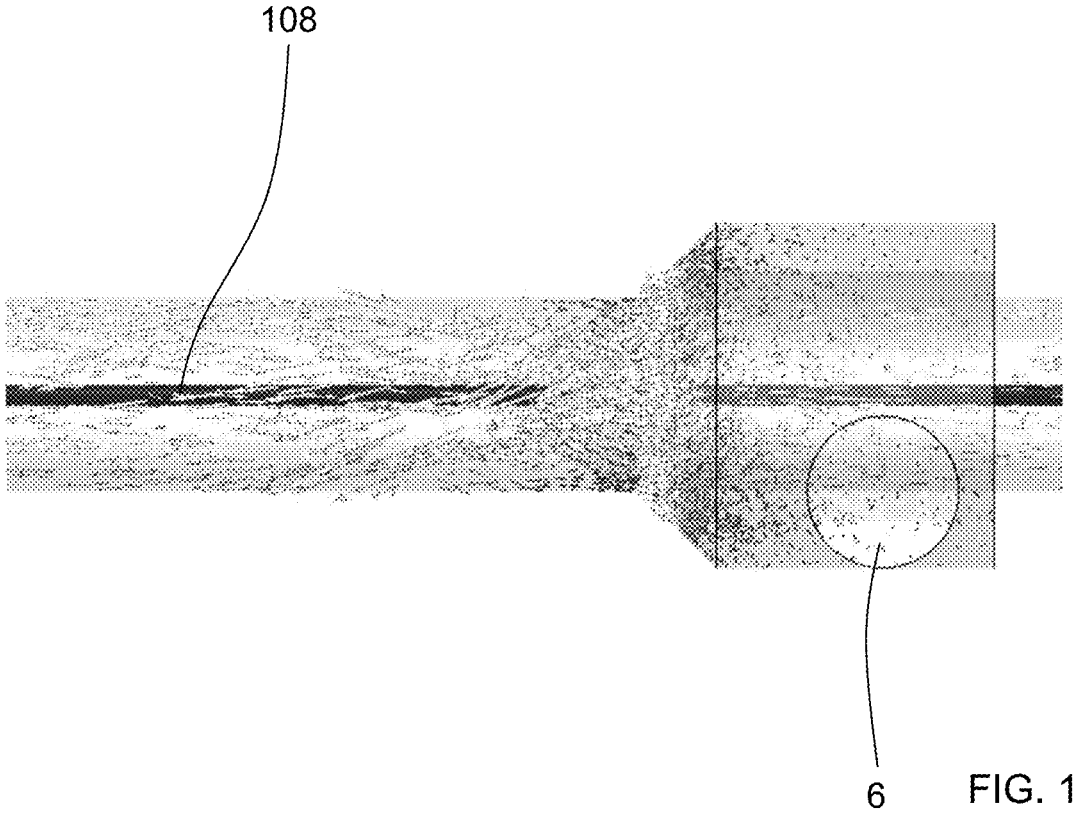
FIG. 11 shows a front view of a computer-assisted simulation in which the vortex formed on the wire can be seen.

The combination of these two features causes the formation of a vortex at the outlet of the wire passage 16 in the partition seen in FIGS. 10 and 11. This vortex surrounds the wire 108, cooling it more efficiently than the known devices. This also means that the length of the coating solidification step can be significantly shortened.

Figure 5:
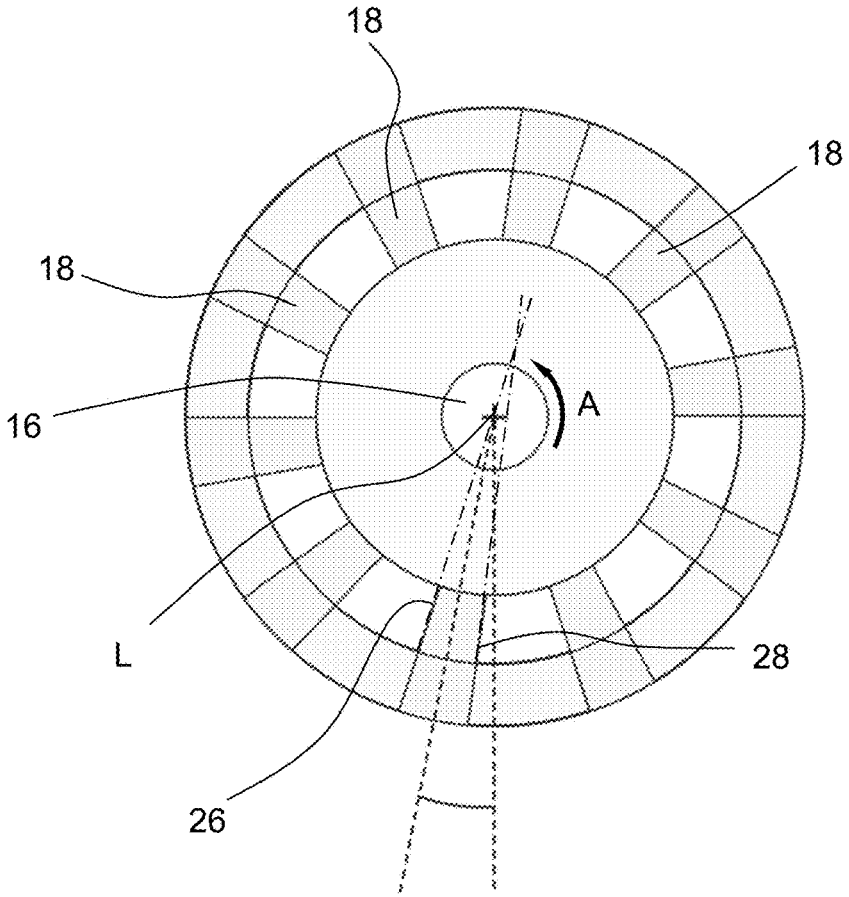
FIG. 5 shows a cross-section through a plane perpendicular to the longitudinal direction of the device, in the area of the plurality of channels fluidically connecting said injection chamber with said cooling chamber.

On the other hand, the way in which the channels 18 lead into the cooling chamber 8 plays a significant role in terms of device efficiency. Thus, in a particularly preferred manner each channel of the plurality of channels 18, seen on a plane P perpendicular to the longitudinal direction L, has a first side wall 26 and a second side wall 28, both seen in FIG. 5. These first and second side walls 26, 28 are configured such that at least one of them is eccentric to the longitudinal axis L, whereas the other one is at least radial. The drawing shows through the dash-dotted lines that, in this case, the first side wall 26 is the radial one, whereas the second side wall 28 is clearly eccentric. The prolongation of these first and second side walls 26, 28 is therefore on one and the same side of said longitudinal axis L. This avoids the formation of liquid streams in opposing directions and obtains a more regular vortex, reducing turbulences. The direction of rotation of the stream is indicated in FIG. 5 by means of arrow A.

On the other hand, also with the movement to improve the deformation-free finishing of the coating layer, each channel of the plurality of channels 18 forms an angle $\alpha$ with respect to the longitudinal direction L which is comprised between 10 and 40° and preferably between 12 and 30°. For example, in FIG. 3 the channels form an angle $\alpha$ of 16° with respect to the longitudinal direction.

This same FIG. 3 also shows how, on the side of the cooling chamber 8, the partitioning wall 14 of the device 1 forms a projection 20 in the cooling chamber 8 tapering in the direction from the injection chamber 2 towards the cooling chamber 8, ending in the wire passage conduit 16. This projection 20 has a substantially frustoconical shape. Thus, in the preferred operating direction of the device 1, which is when the longitudinal direction L is in the vertical direction, it allows collecting the pouring cooling liquid and preventing it from entering the injection chamber 2 again. Also in this same direction and to prevent the pouring water from being led to the wire passage 16, the device 1 of the drawing has walls of the cooling chamber 8 which, at the end of the wire outlet 10, taper between the cooling chamber and the wire outlet 10 in the form of a Coanda surface. This surface helps to collect the cooling liquid and leads it to the side walls of the cooling chamber 8, facilitating the exit thereof through the liquid outlet 12.

After having described the device 1 according to the invention in detail, an installation 100 according to the invention for solidifying a coating layer hot deposited on a wire 108 is described below.

Figure 6:
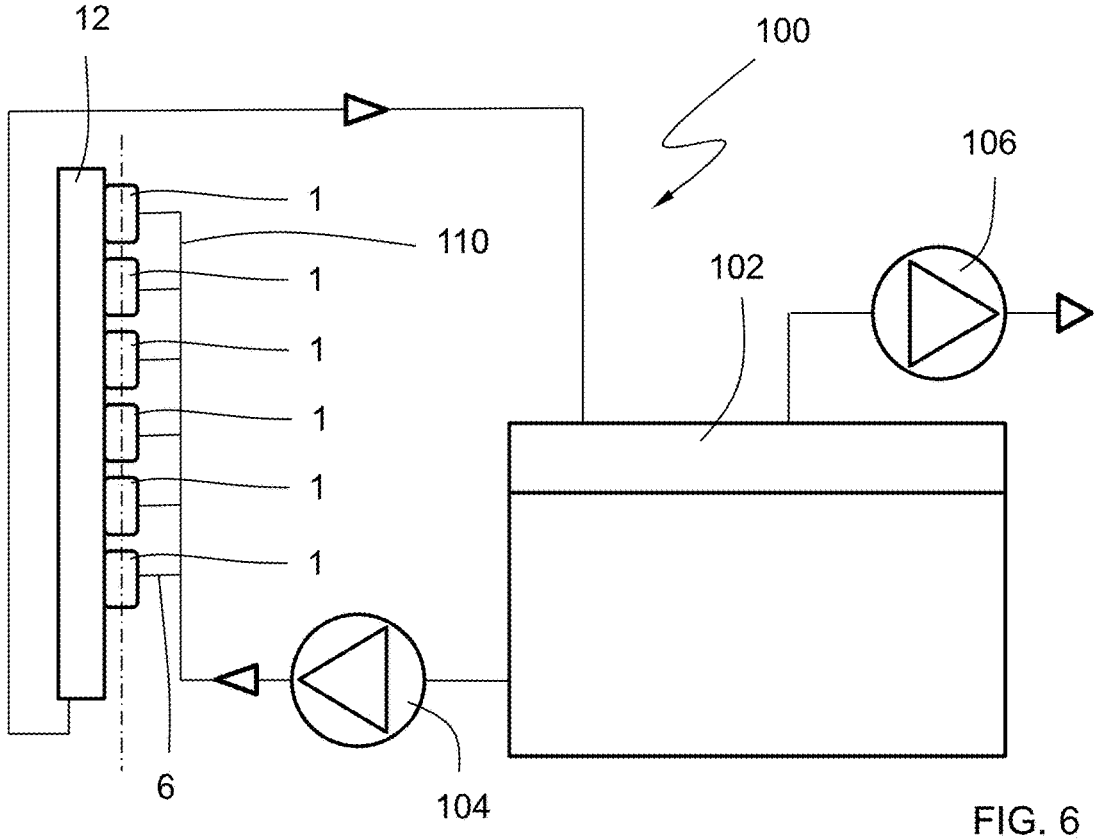
FIG. 6 shows a schematic view of the installation according to the invention.
Figure 7:
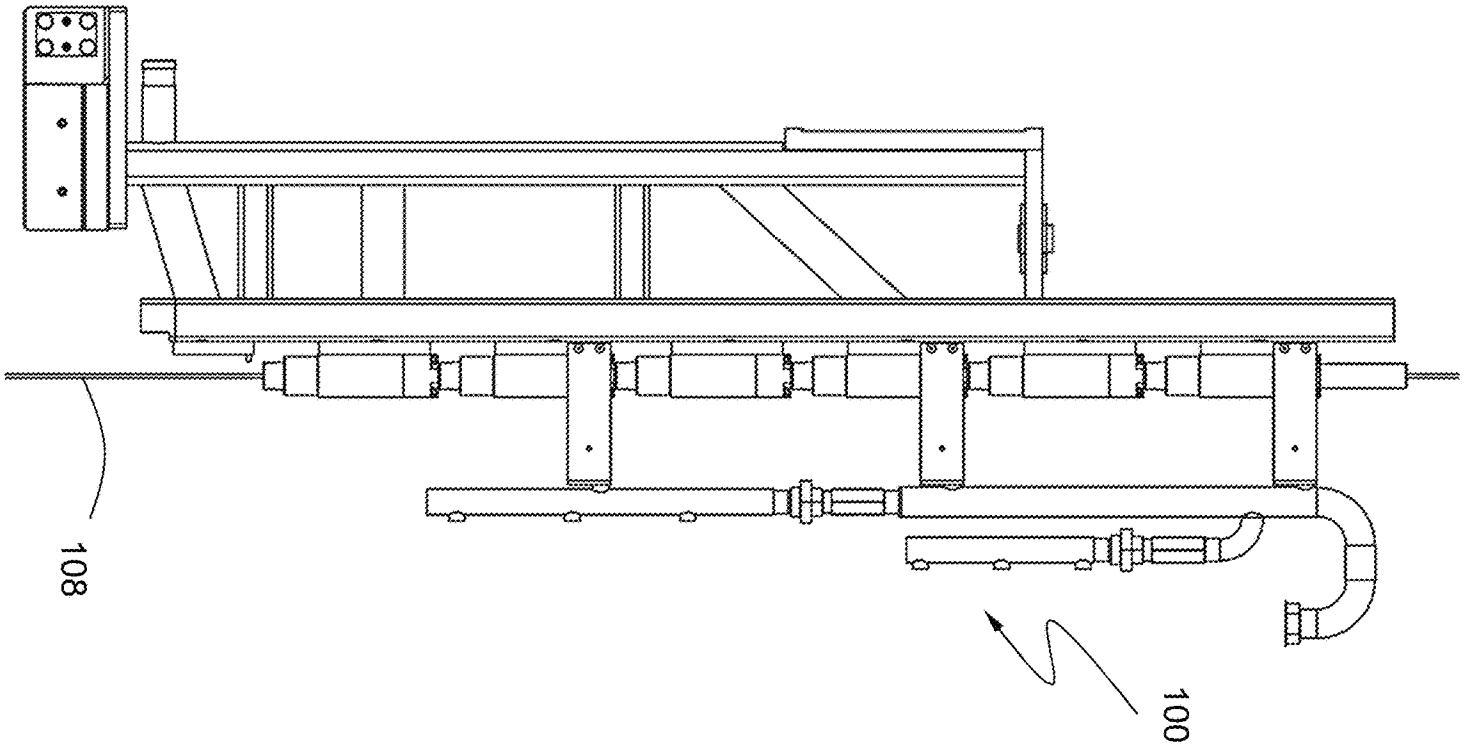
FIG. 7 shows a detailed side view of the installation according to the invention provided with a plurality of devices connected in series.
Figure 8:
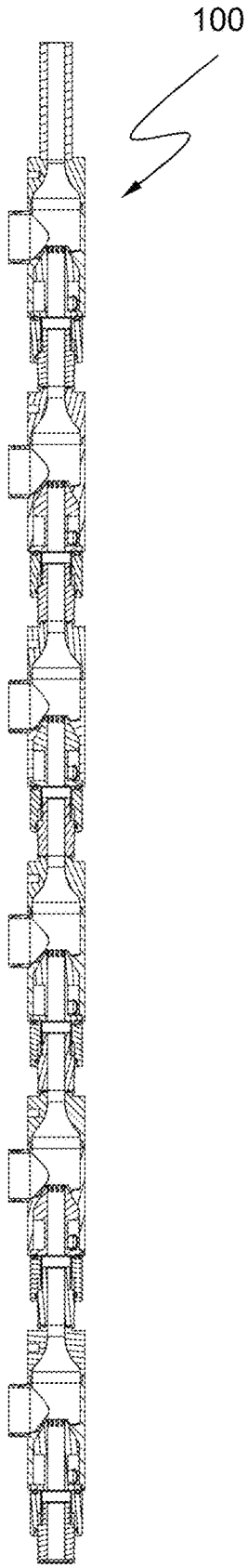
FIG. 8 shows a longitudinally sectioned view of a plurality of devices according to the invention connected in series.

FIG. 6 shows a schematic installation having six devices 1 according to the invention connected in series arranged such that their longitudinal direction L corresponds to the vertical direction.

The lower device 1 has the wire outlet 10 connected with the wire inlet 4 of the adjacent device 1 and so on and so forth all the way to the upper device 1, the wire outlet 10 of which is free.

The installation has a cooling liquid tank 102 and thrusting means 104. In this embodiment, the thrusting means are a fan. Alternatively, they may be a hydraulic pump. The thrusting means 104 fluidically connect the tank 102 with each of the liquid inlets 6 of each of the six devices 1 through a main conduit 110. Thanks to the thrusting means 104, the cooling liquid is thrust into each of the injection chambers 2.

The injection chamber 2 is separated from the wire passage 16 through the conduit 22. A plenum which allows balancing the injection pressure in each of the devices 1 is thereby formed. The injection chamber 2 must be filled upon starting up the installation. Thus, when the injection chamber 2 is full, at a certain pressure, the cooling liquid is then introduced in the channels 18 and it moves upward to the cooling chamber 8.

Figure 9A:
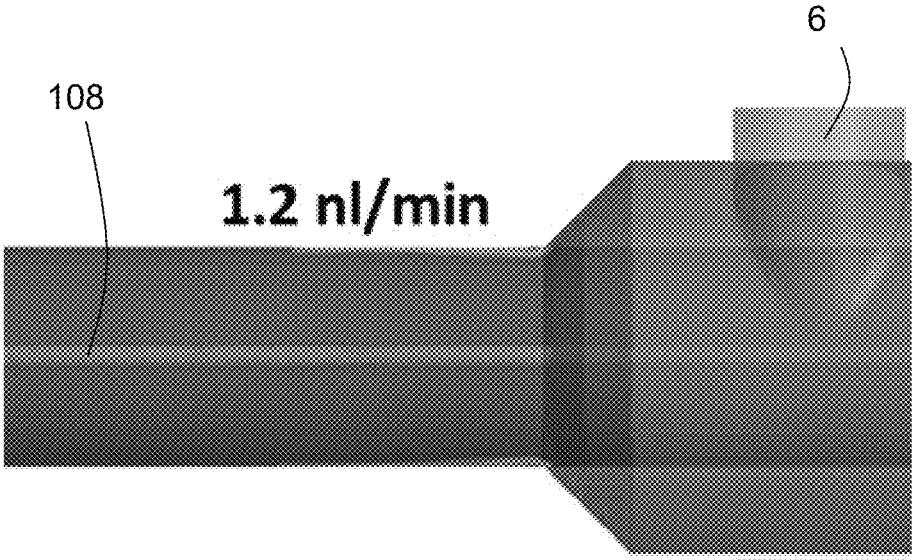
FIGS. 9A to 9C show a simulation of the flow lines on the wire at different levels of flow rate.
Figure 9B:
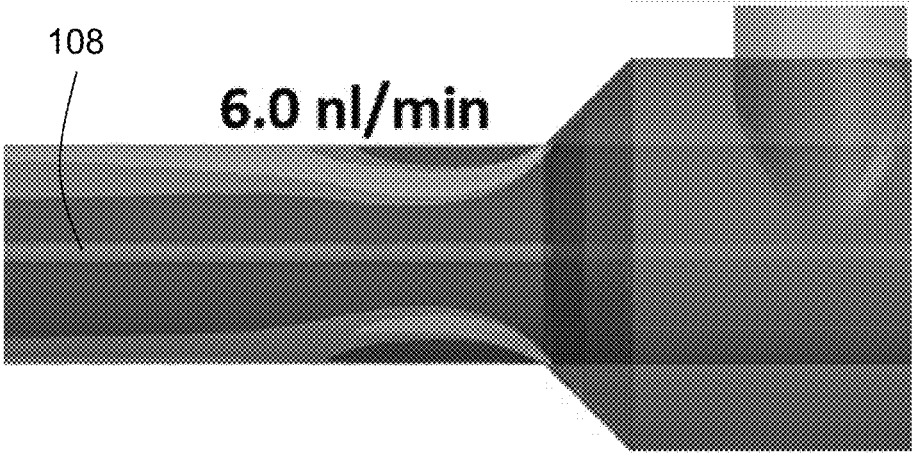
Figure 9C:
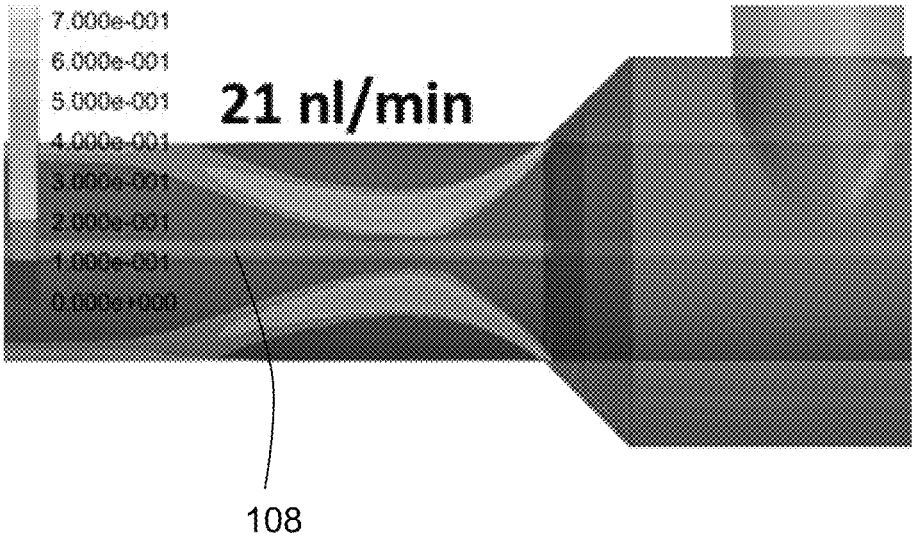

FIGS. 9A to 9C show the effect achieved through the angle $\alpha$ of inclination of the channels 18. As can be seen, as the flow rate circulating through the channels 18 increases from 6 l/min to 21 l/m, the speed with which the cooling liquid "rubs against" the surface of the wire to be cooled increases. An angle perpendicular to the wire 108 would cause significant deformations on the coating surface, whereas a non-parallel angle would not provide efficient cooling. Thanks to the flow having a longitudinal component in the same direction as the forward movement of the wire 108, an optimum operating range is achieved, in which the formation of irregularities on the surface of the wire 108 is avoided and a very efficient cooling is achieved.

Then, FIGS. 10 and 11 show the effect achieved thanks to the eccentricity of the channels 18 with respect to the wire 108 to be cooled. The direction of the velocity vectors shows how the vortex is formed around the wire 108. This vortex causes a particularly efficient cooling and hardening of the coating layer, but without damaging the coating surface or causing irregularities.

The installation 100 according to the invention also has suction means 106. In this embodiment, the suction means are a fan. These suction means 106 are in charge of keeping the tank 102 under vacuum. A closed circuit is thereby created in which the circuit between the liquid outlet 12 and the inlet of the tank 102 is under negative pressure for discharging the cooling liquid from the cooling chamber of each of the devices 1 to the tank 102. Once in the tank 102, the cooling liquid is again thrust by the fan 104. A closed cooling circuit is thereby formed.

The installation 100 according to the invention therefore allows putting into practice the method according to the invention for solidifying a coating layer hot deposited on a wire 108 at a high speed, in an efficient manner, but with a better-quality surface finish.

In the method, the wire 108 is moved forward along the longitudinal direction L. A plurality of jets of cooling liquid is projected through each of the devices 1 in a manner that eccentric with respect to the center of the wire 16 and transverse to the longitudinal direction L in the forward movement direction of the wire 108. During the forward movement of the wire 108, the suction means 106 create a negative pressure downstream of the liquid outlet 12 which returns the liquid to the tank 102.

To achieve optimum results in the solidification of the coating layer in the step of projecting, said liquid is injected into the injection chamber with a flow rate between 2 and 25 l/min, which provides injection speeds between 6 and 25 m/s at the outlet of the channels 18.

Finally, it must be mentioned that the installation according to the invention can be installed in wire processing lines of any type in which there is a step of coating using a coating to be solidified.

By way of example, the invention contemplates assembling the installation according to the invention at the end of a line for continuously processing wire by galvanization. Installations of this type can be single-wire or multi-wire installations. Thus, in the event of a multi-wire processing line, the line would include as many coating layer solidification installations as there are wires to be processed.

The invention claimed is:

1. A device for solidifying a coating layer hot deposited on a wire, said device extending along a longitudinal direction defining the path of passage of said wire, characterized in that it comprises

[a] a cooling liquid injection chamber with a cooling liquid inlet and a wire inlet, said injection chamber being cylindrical,

[b] a cooling chamber with a cooling liquid outlet and a wire outlet,

[c] a partition arranged between said injection and cooling chambers, comprising a wire passage communicating said injection chamber and said cooling chamber with one another,

[d] a conduit for separating said wire, extending between said wire inlet and said wire passage,

[e] said partition comprises a plurality of channels fluidically connecting said injection chamber with said cooling chamber, said plurality of channels leading into the center of said wire passage in an eccentric manner such that each channel of said plurality of channels seen on a plane perpendicular to said longitudinal direction has a first side wall and a second side wall, said first and second side walls being configured such that at least one of them is eccentric to said longitudinal axis, and the other one is at least radial, the prolongation of said first and second side walls being on one and the same side of said longitudinal axis and

[f] said plurality of channels being inclined forming an angle with respect to said longitudinal direction which is comprised between 10 and 40° for aiming a jet of cooling liquid on said wire in the direction from said injection chamber towards said cooling chamber.

2. The device according to claim 1, wherein each channel of said plurality of channels forms an angle with respect to the longitudinal direction between 12 and 30º.

3. The device according to claim 1, wherein on the side of said cooling chamber, said partitioning wall forms a projection in said cooling chamber tapering in the direction from said injection chamber towards said cooling chamber and ending in said wire passage conduit.

4. The device according to claim 1, wherein said inlet is eccentric with respect to said longitudinal axis, such that it is at least tangent to the outer diameter of the conduit for separating said wire.

5. The device according to claim 1, wherein the walls of said cooling chamber, at the end of said wire outlet, taper between said cooling chamber and said wire outlet in the form of a Coanda surface.

* * * * *